United States Patent [19]

Sartor

[11] Patent Number: 4,724,625

[45] Date of Patent: Feb. 16, 1988

[54] SKI BOOT, PARTICULARLY OF THE REAR-ENTRY TYPE, WITH A DEVICE FOR SECURING THE HEEL

[75] Inventor: Mariano Sartor, Montebelluna, Italy

[73] Assignee: Nordica S.p.A., Montebelluna, Italy

[21] Appl. No.: 885,613

[22] Filed: Jul. 14, 1986

[30] Foreign Application Priority Data

Jul. 23, 1985 [IT] Italy ..... 22576/85[U]

[51] Int. Cl.[4] ..... A43B 5/04; A43B 23/28

[52] U.S. Cl. ..... 36/117; 36/58.5; 36/120

[58] Field of Search ..... 36/117–121, 36/58.5, 89, 92

[56] References Cited

U.S. PATENT DOCUMENTS

| | | | |
|---|---|---|---|
| 1,781,197 | 11/1930 | Schroeter . | |
| 2,935,798 | 5/1960 | Piberhofer | 36/119 |
| 3,945,135 | 3/1976 | Hanson et al. | 36/121 |
| 4,547,981 | 10/1985 | Thais et al. | 36/89 |
| 4,615,127 | 10/1986 | Delery | 36/117 |

FOREIGN PATENT DOCUMENTS

| | | | |
|---|---|---|---|
| 2107659 | 9/1972 | Fed. Rep. of Germany | 36/117 |
| 2732522 | 1/1978 | Fed. Rep. of Germany | 36/121 |

*Primary Examiner*—James Kee Chi

*Attorney, Agent, or Firm*—Guido Modiano; Albert Josif

[57] ABSTRACT

A ski boot, particularly of the rear-entry type, with a device for securing the heel comprising an elongated element which extends transversely relatively to the longitudinal extension of the rear quarter. The elongated element is accommodated inside the rear quarter, substantially at the level of the heel of the user, and is connected with the mutually opposite longitudinal edges of the rear quarter.

14 Claims, 9 Drawing Figures

SKI BOOT, PARTICULARLY OF THE REAR-ENTRY TYPE, WITH A DEVICE FOR SECURING THE HEEL

BACKGROUND OF THE INVENTION

The present invention relates to a ski boot, particularly of the rear-entry type, with a device for securing the heel.

As is known, in manufacturing ski boots, and especially rear-entry ski boots, remarkable problems are encountered in affording a good securing of the heel. These disadvantages derive directly from the kind of construction used for ski boots, which brings abou, in the heel area, a grouping of several elements closely arranged side-by-side , that is to say the shell and the front and rear quarters, respectively pivoted to the shell.

The securing or fastening action which can be exerted at the heel area is not constant and depends directly on the kind of leg of the user and on the securing force exerted, so that there is always a certain gap which is difficult to recover in order to obtain an effective securing of the heel.

It must be furthermore added that, during the flexing phase of the quarters relatively to the shell, the rear quarter, the front quarter and the shell which surround the ankle of the user generally tend to play out, that is to say, to open towards the outside, so that the securing of the heel is made even more precarious.

SUMMARY OF THE INVENTION

The aim of the invention is indeed to eliminate the disadvantages previously described by providing a ski boot of the rear-entry type with a securing mechanism for the heel, which allows for adjusting the securing action on the heel, without thereby entailing exertion of large efforts or difficult operations for the user.

A particular object of the invention is to provide a ski boot in which the securing device for the heel is also capable of eliminating or anyway countering in an effective manner the ski boot splaying out during the flexing phase, thus maintaining even under these conditions an effective heel securing action.

Still another object of the present invention is to provide a ski boot which allows for easily and quickly adjusting the heel securing device, thus adapting itself to the contingent requirements of the various users.

Not least object of the present invention is to provide a ski boot, in which the securing device may be provided with commonly available means and at a very modest cost.

The above described aim, as well as the objects described and others which will better appear hereinafter, are achieved by a ski boot, particularly of the rear-entry type, with a heel securing device, characterized in that it comprises an elongated element having connecting means for connecting said elongated element to mutually opposite longitudinal edges of a ski boot rear quarter, said elongated element, in the use position thereof, extending transversely to the longitudinal extension of said rear quarter, inside said rear quarter and substantially proximate to the heel of a user's foot.

BRIEF DESCRIPTION OF THE DRAWINGS

Further features and advantages will appear more clearly from the detailed description of a ski boot of the rear-entry type with a device for securing the heel, illustrated by way of example only in the accompanying drawings, where.

DESCRIPTION OF THE PREFERRED EMBODIMENTS

Figure 9:
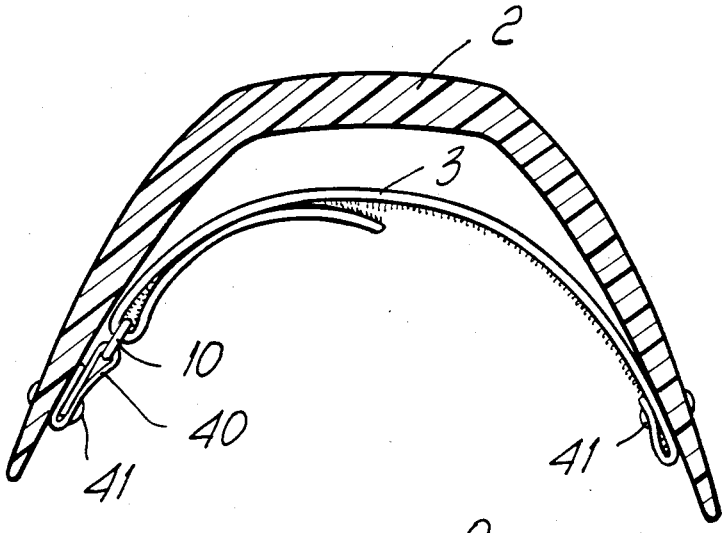
FIG. 9 is a cross section view of the securing device of FIG. 8 fitted to the rear quarter.

With reference to the above drawings, the ski boot of the rear-entry type, according to the invention, comprises, in a per se known manner, a shell 1 to which a rear quarter 2 and a front quarter, which is not illustrated in the accompanying drawings, are pivotably coupled. The rear quarter has opposite lateral flap portion *2a, 2b* with upwardly extending lateral edges *2c, 2d* and a middle portion *2e* (FIG. 9).

According to the invention the boot is endowed with a heel securing device, which is composed of a flexible elongated element 3 which extends transversely relatively to the longitudinal extension of the rear quarter 2. in the cavity provided by its concave configuration arcuated in cross-section The elongated element 3 may comprise a cable or a band, as an example constituted by a tear-strip of the kind commercially known by the trade-name Velcro.

The elongated element 3 can be positioned inside the rear quarter. As clearly visible in FIG. 9 the developed length of the flexible element 3 is smaller than the cross-sectionally developed length of the concave configurations of the rear quarter 2. Thereby the element 3 is normally at a distance from the middle portion 2e of the quarter 2.

On the elongated element 3, means are provided for adjusting its useful length, which, in this case, with the elongated element in the form of a tear-strip, are simply composed of a ring 10 in which an end of said tear-strip can be inserted, which strip can be thus closed on itself.

Advantageously, the elongated element 3, at one end thereof defines a fixed loop 11 which is associated to a ring, still indicated at 10, which is pivotably coupled with a fixing plate 12.

Similarly, at the other end where the adjustable loop is provided for adjusting the useful length, the ring 10 is also coupled to a plate 12.

The plates 12 are pivotably associated by means of pins 13 with hook-like elements generally indicated at 20 and forming the means for connecting the elongated element 3 to the longitudinal edges of the rear quarter.

More in detail, the hook-like elements 20 define an internal wing 21 to which can be pivoted, by means of the pin 13, the plate 12 and an external wing 22 having, at its free end, a tooth 23 which can be inserted in slots 24 provided on a recess or depressed portion 25 formed in the longitudinal edges of the rear quarter.

The recesses 25 may present several slots 24 set apart relatively to the longitudinal extension of the boot and forming means for the elevation positioning of the heel securing device, which can thus be always positioned substantially at the Achilles' tendon of the user's heel.

Figure 7:
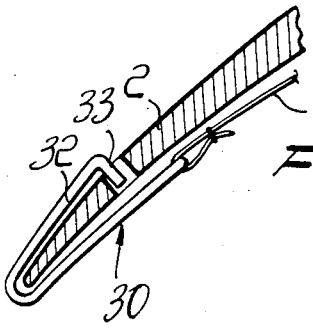
FIG. 7 is a cross section view of the securing element of FIG. 6 applied to the ski boot.
Figure 5:
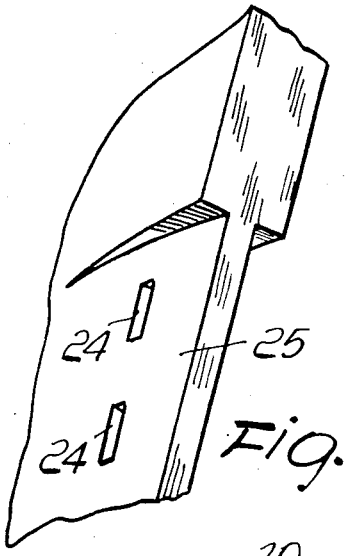
FIG. 5 is a perspective view of the edge of the quarter where the securing device is attached.
Figure 6:
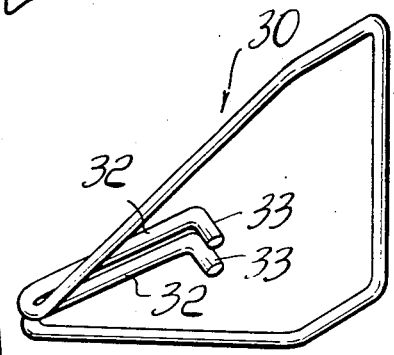
FIG. 6 is a perspective view of a simplified securing element.
Figure 1:
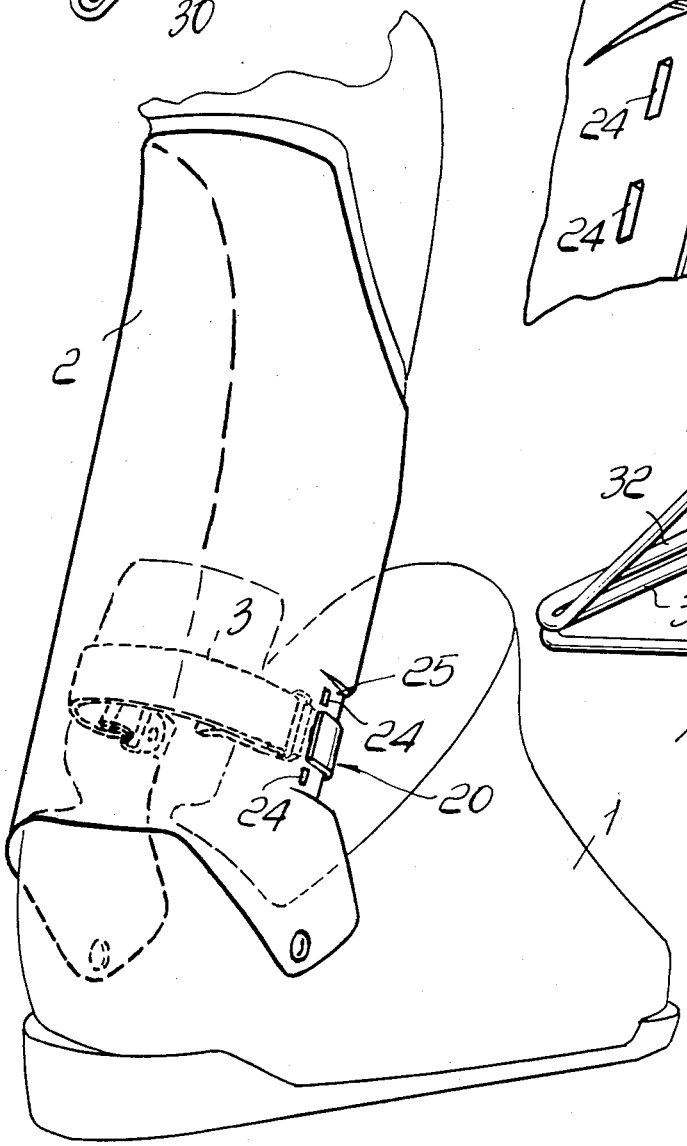
FIG. 1 is a schematic perspective view of the ski boot with the front quarter removed, according to the invention.
Figure 2:
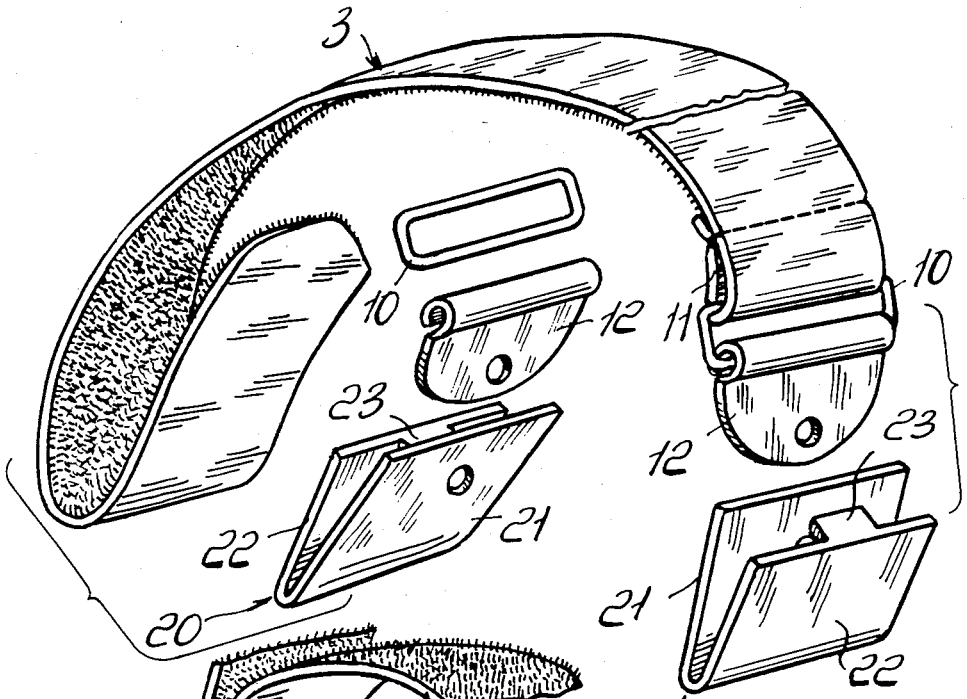
FIG. 2 is an exploded perspective view of the detail of the securing device.
Figure 3:
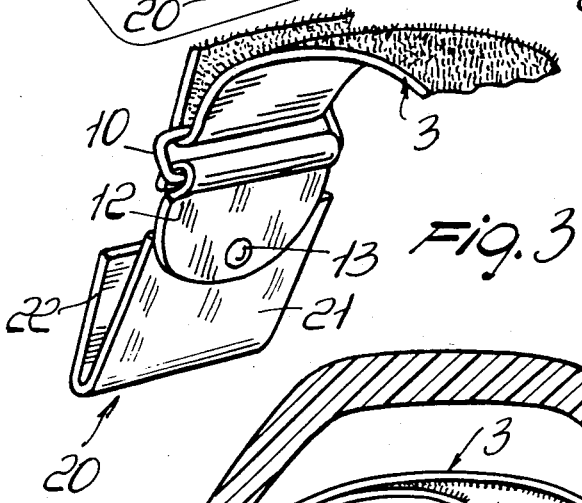
FIG. 3 is a perspective view of the means for connecting the securing device to the quarter.
Figure 4:
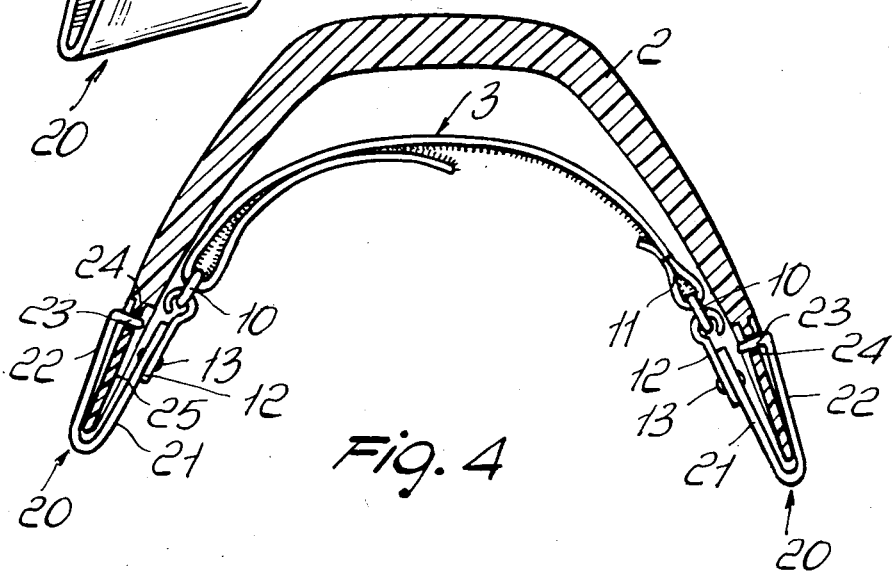
FIG. 4 is a transverse cross section of the rear quarter of the ski boot with the heel securing device fitted.

As illustrated in FIGS. 6 and 7, it is possible to employ a simplified securing element, generally indicated at 30, which is obtained from bent wire. The element 30 defines, in one piece, a section 31, intended to engage with the elongated element 3, which portion couples with folded sections 32 ending in hooking sections 33, which can be inserted into the slots 24.

It must be furthermore added that the elongated element 3 can directly act onto the user's foot or on a small interposed pad or ribbon which also acts as a pressure-distributing element.

Figure 8:
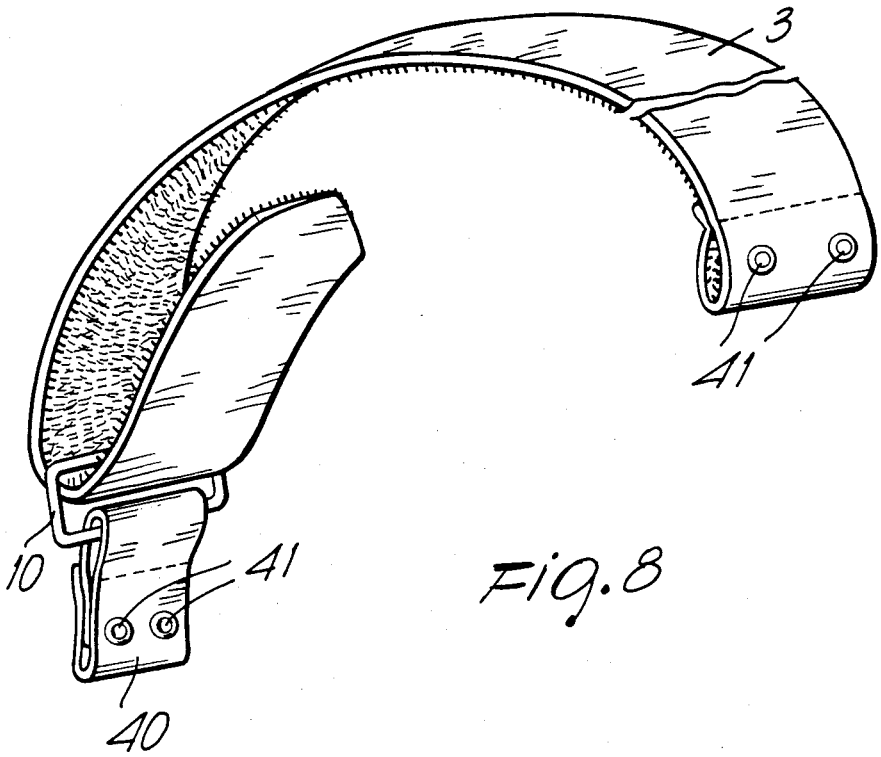
FIG. 8 is a perspective view of a simplified embodiment of the heel securing device.

According to a further simplified embodiment, illustrated in the FIGS. 8 and 9, the elongated element 3 at one end is directly fixed to the rear quarter 2 by means of rivets 41 or the like. At the other end, the elongated element 3 is inserted into the ring 10 associated to a small band 40 or the like, fixed to the quarter 2 by means of rivets or the like, still indicated at 41.

In practical use, the user adjusts the useful length of the elongated element 3 and positions it to the desired height.

As previously described, this elongated element is coupled to the hook-like elements 20 by means of the pins 13 which allow for the free orientation for perfect adaptation to the various kinds of leg.

When the quarter is tightened, thus the band-like element exerts a pressing and blocking action localized in the rear area of the heel, and furthermore, since it is coupled to the longitudinal edges of the rear quarter 2, it holds the latter against the outward divarications which constitute the typical splaying out described above.

From what has been described, it can be seen that the invention achieves the intended objects and in particular the fact is noted that by very simple, quick and easy to use means it is possible to provide a boot having effective heel securing means.

Practically the materials employed, as long as compatible with the specific use, as well as the contingent dimensions and shapes, may be any according to the requirements.

I claim:

1. In a ski boot construction having a shell portion, a rear quarter associated to said shell portion, said rear quarter having opposite lateral flap portions spaced apart from each other and a middle portion connecting said opposite lateral flap portions to define a concave configuration facing inwards and arcuate in cross- section and having a preestablished cross-sectionally developed length, said flap portions having upwardly extending opposite spaced apart lateral edge portions delimiting laterally said concave configuration, a heel securing device comprising, an elongated flexible element having a developed length which is smaller than said cross-sectionally developed length, said elongated flexible element having end portions thereof having connecting means for securing said end portions to said opposite spaced apart lateral edge portions thereby said elongated flexible element normally extendig cross-sectionally across said arcuated configuration internally at a distance at least from said middle portion to exert in use a pressing and blocking action on the wearer's heel and simultaneously prevent outward divarication of said opposite lateral edge portions when said quarter is tightened.

2. A ski boot according to claim 1, wherein said flexible elongated element is a strap-like member.

3. A ski boot according to claim 1, further comprising means for the adjustment of the useful length of said elongated element.

4. A ski boot, according to claim 1, wherein said elongated element comprises a cable.

5. A ski boot, according to claim 1, wherein said elongated element comprises a tear-strip section and said useful-length adjustment means comprises a ring whereinto a free end of said elongated element is inserted for closing on said tear-strip for a preselectable amount.

6. A ski boot, according to claim 1, wherein said connecting means comprise at least on one end portion of said elongated element a ring connected with said end portion, a plate member in engagement with said ring and a hook-like element having a wing connected to said plate.

7. A ski boot, according to claim 6, wherein said hook-like element includes a pivoting pin for connecting said hook-like element to said plate.

8. A ski boot, according to claim 1, wherein said lateral edge portions of said quarter have recesses defined therein and slots formed in said recesses and wherein said connecting means comprise at least one hook-like element formed from a plate member bent at a middle portion thereof and defining a first wing and a second wing, a ring engaging an end portion of said elongated element and a small plate hinged to said ring, said first wing of said plate member being pivotally connected to said small plate and wherein said second wing has at an edge portion thereof an engagement tooth for engagement in said slots formed in recesses defined in said longitudinal edges of said rear quarter.

9. A ski boot, according to claim 1, wherein said connecting means comprises tooth members arranged at the end of said elongated element and slots formed in said longitudinal edges for engagement therewith, said securing device further comprising adjusting means for setting the heigh position of said securing device, said adjusting means including a plurality of said slots set apart from each other along the longitudinal extension of said rear quarter.

10. A ski boot, according to claim 1, wherein said elongated element acts upon a small pad element defined by the shell of said ski boot.

11. A ski boot, according to claim 1, wherein said elongated element acts directly against the foot of the user.

12. A ski boot, according to claim 1, wherein said connecting means comprises a securing element made from a bent metallic wire defining in one piece an engagement section for engagement with said elongated element, and folded sections having hooking end sections.

13. A ski boot, according claim 1, wherein said elongated element at one end thereof is fixedly attached to said rear quarter and at another end thereof engages in a ring attached to a small band fixedly secured to said ski boot rear quarter.

14. A ski boot particularly of the rear entry type, with a heel securing device, comprising an elongated element having connecting means for connecting said elongated element to mutually opposite longitudinal edges of a ski boot rear quarter, said elongated element, in the use position thereof, extending transversely to the longitudinal extension of said rear quarter inside said rear quarter and substantially proximate to the heel of a users foot, wherein said elongated element comprises a tear-strip section having means for the adjustment of the useful length-thereof, and said useful-length adjustment means comprises a ring whereinto a free end of said elongated element is inserted for closing on said tear-strip for a preselectable amount.

* * * * *